United States Patent [19]

Rogers, Sr.

[11] Patent Number: 4,693,669

[45] Date of Patent: Sep. 15, 1987

[54] SUPERCHARGER FOR AUTOMOBILE ENGINES

[76] Inventor: Leroy K. Rogers, Sr., Rte. 13, P.O. Box 815-DD, Briarcliff Rd., Fort Myers, Fla. 33908

[21] Appl. No.: 717,652

[22] Filed: Mar. 29, 1985

[51] Int. Cl.[4] ..... F04D 17/02; F04D 29/40

[52] U.S. Cl. ..... 415/143; 415/199.6; 415/140; 415/219 C

[58] Field of Search ..... 415/131, 132, 140, 142, 415/143, 198.1, 199.1, 199.4, 199.6, 207, 219 C

[56] References Cited

U.S. PATENT DOCUMENTS

| | | | |
|---|---|---|---|
| 759,584 | 5/1904 | Wyland | 415/199.6 X |
| 1,585,218 | 5/1926 | Watanabe | 415/131 X |
| 2,013,079 | 9/1935 | Slocum | 415/143 X |
| 2,408,918 | 10/1946 | Curtis | 415/199.6 X |
| 2,418,184 | 4/1947 | McConaghy | 415/199.6 X |
| 2,570,081 | 10/1951 | Szczeniowski | 415/143 X |
| 2,625,883 | 1/1953 | Howser | 415/131 X |
| 2,681,645 | 6/1954 | Hoke, Jr. | 123/559 |
| 2,767,549 | 10/1956 | Martin | 415/140 X |
| 2,933,884 | 4/1960 | Foster | 415/199.6 X |
| 3,046,901 | 7/1962 | Montgomery | 415/143 |
| 3,143,103 | 8/1964 | Zuhn | 415/199.6 X |
| 3,155,044 | 4/1960 | Lattanzio et al. | 415/142 |
| 3,370,417 | 2/1968 | Koziara | 123/559 X |
| 3,692,420 | 9/1972 | Mittelstaedt | 415/62 |
| 3,775,023 | 11/1973 | Davis et al. | 415/143 X |
| 3,918,828 | 11/1975 | Kumm | 415/61 |
| 3,918,852 | 11/1975 | Carter | 415/143 X |
| 3,924,963 | 12/1975 | Zerrer | 415/143 |
| 3,935,847 | 2/1976 | Gamell | 123/119 CF |
| 4,292,804 | 10/1981 | Rogers, Sr. | 60/407 |

FOREIGN PATENT DOCUMENTS 3012406 10/1981 Fed. Rep. of Germany .

*Primary Examiner*—Robert E. Garrett
*Assistant Examiner*—Joseph M. Pitko
*Attorney, Agent, or Firm*—Burns, Doane, Swecker & Mathis

[57] ABSTRACT

A supercharger for delivering supercharged air to an engine, comprising a shrouded axial compressor, a radial compressor which is located downstream of the axial compressor and a housing. The housing comprising four sections, including a section defining a highly convergent, frustoconical transition duct which favorably directs the discharge of the axial compressor to the inlet of the radial compressor and a hollow, highly convergent, exhaust cone section immediately downstream of the radial compressor which converges into the exhaust port of the supercharger. An annular flow deflector is provided for directing the discharge of the radial compressor into the exhaust cone.

7 Claims, 8 Drawing Figures

Fig. 2
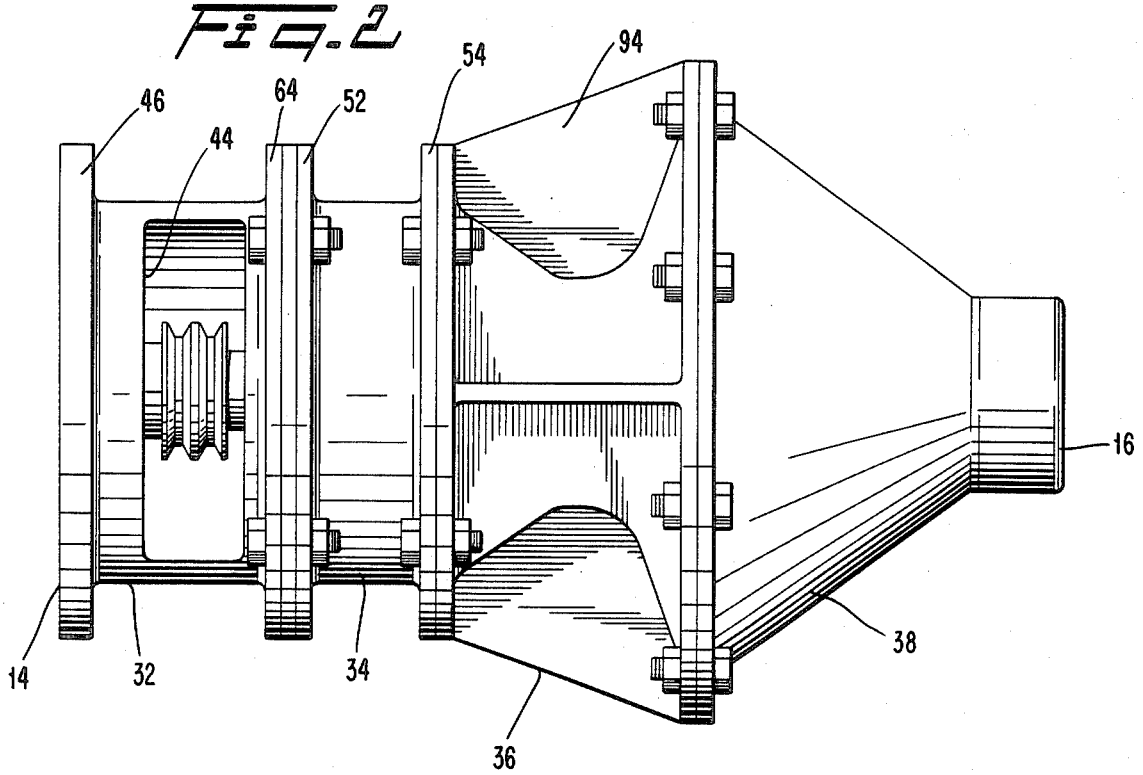
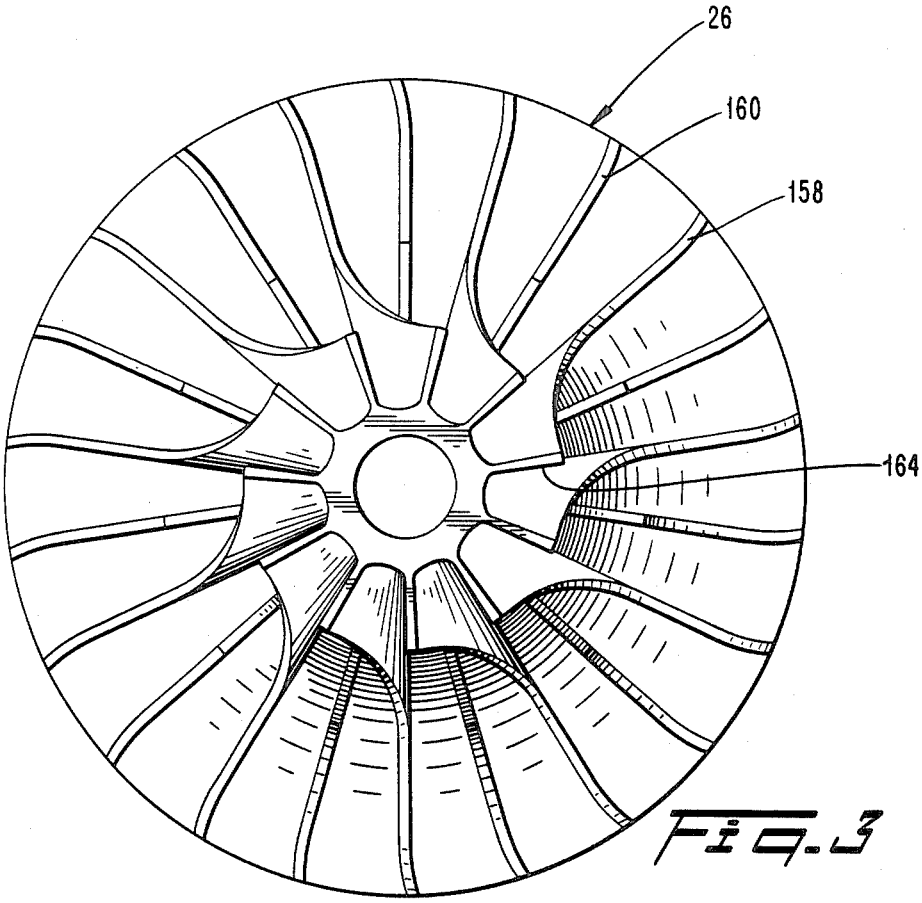
Fig. 3

Fig. 4
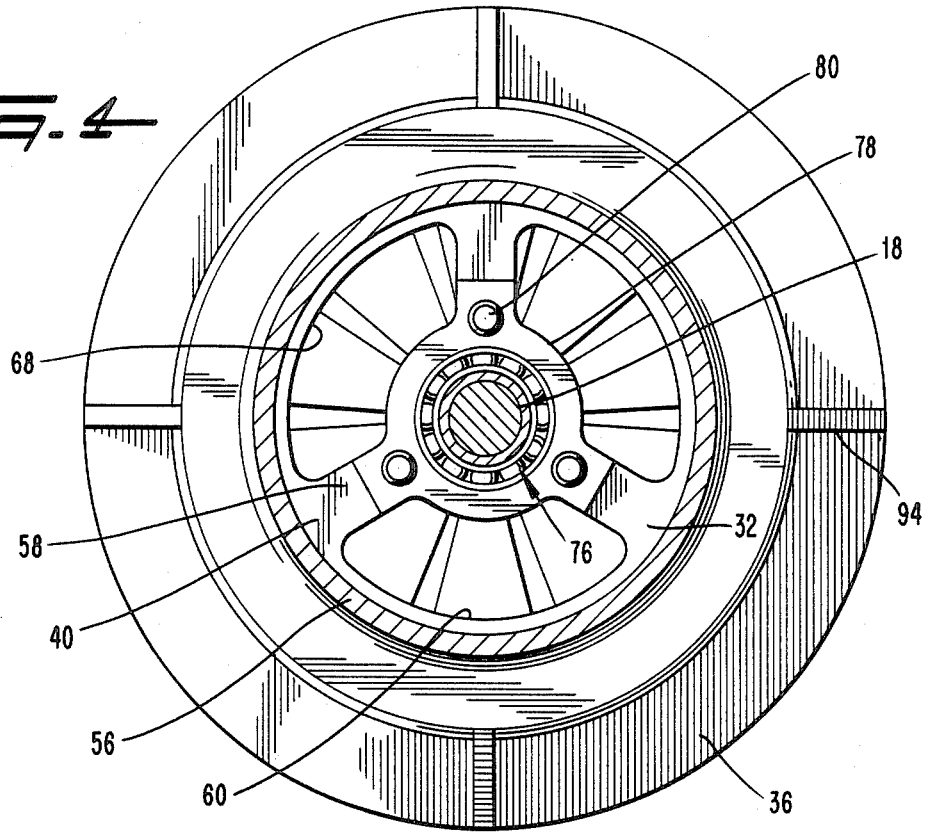
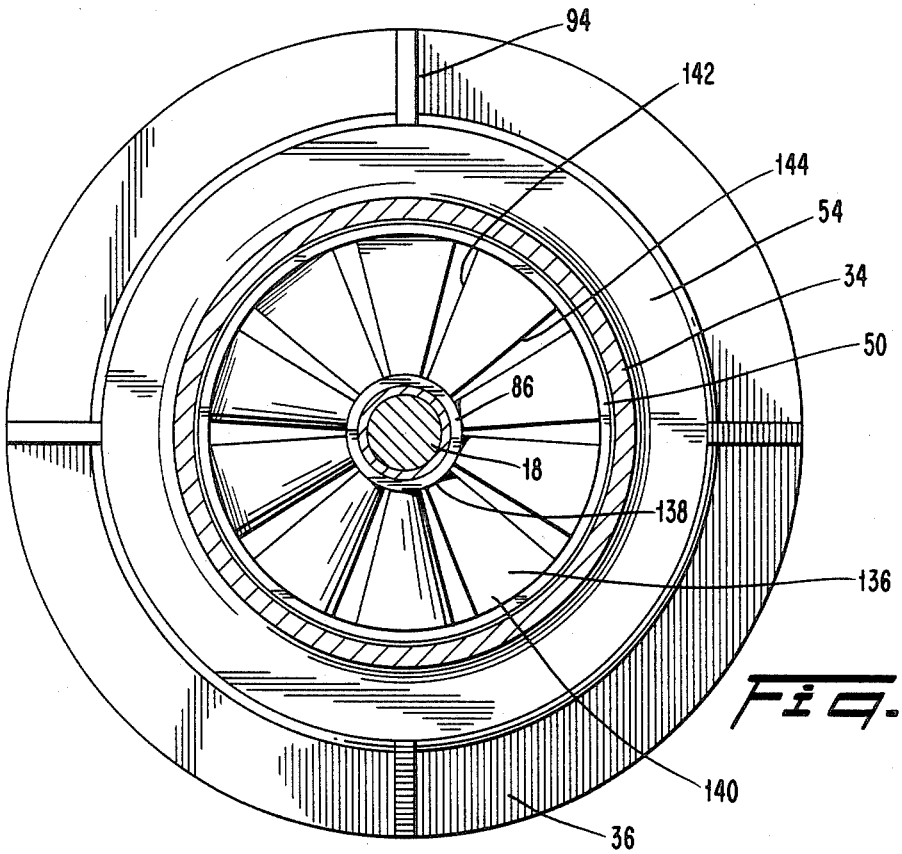
Fig. 5

SUPERCHARGER FOR AUTOMOBILE ENGINES

FIELD OF THE INVENTION

The present invention relates to superchargers generally and more particularly to superchargers for automotive engines which include both an axial stage compressor and a centrifugal stage compressor.

BACKGROUND OF THE INVENTION

Superchargers impart additional pressure to the air or the air/fuel mixture of an engine so that the cylinders receive a greater weight per unit volume of air or air/fuel mixture than would otherwise be supplied. As a result, the volumetric efficiency and power output of the engine are improved.

According to prior practices, superchargers generally comprise a single airblower which forces air on an air/fuel mixture into the cylinders of an engine. Typically, the airblower is driven by a gear train which is connected to the crankshaft of the engine with a gear ratio of about 6 to 1. These prior types of superchargers have been used extensively in racing engines and radial aircraft engines. However, by reason of their high operating speeds and their gear trains, these superchargers have been considered too complicated, too heavy and too costly for use with mass production engines such as are found in automobiles and trucks.

Recently, some automobile manufacturers have been offering turbocharged engines which expand to exhaust gases of the engine through a turbine to drive a centrifugal compressor. Although turbochargers are advantageous in that the turbine can deliver large amounts of power to the compressor, their extreme operating speeds require special bearings, lubrication and maintenance. In addition, turbochargers require special ducting, such as by-pass arrangements, which only add to their cost and maintenance requirements. Consequently, turbochargers are only offered as expensive options in automobiles.

Further, there is current interest in a new type of automobile engine which operates from tanks of compressed gas to effect reciprocation of its pistons. An example of such an engine can be found in the U.S. Pat. No. 4,292,804 issued to the same inventor of the present invention. In the referenced patent, at least a portion of the partially expanded exhaust gas from the cylinders is directed to a compressor where it is recompressed and then returned to the storage tanks from whence it originally came. It would be desirable that at least some, if not all of the aforementioned recompression of the exhaust gas could be achieved with a belt-driven, rotary supercharger that is easily manufactured and maintained, yet is capable of providing ample recompression.

OBJECTS OF THE INVENTION

Accordingly, an object of the present invention is to provide a supercharger suitable for improving the performance of engines of automobiles, helicoptors or the like, which supercharger is inexpensive to produce and easy to maintain.

It is another object of the present invention to provide a supercharger which provides sufficient boost without resort to extreme operating speeds and accordingly avoids the costly complications associated with high speed operation.

It is yet another object of the present invention to provide a relatively compact and lightweight supercharger which is inexpensive to manufacture and maintain.

Another object of the present invention is to provide a belt-driven supercharger having a design which provides supercharging compression at relatively low operating speeds.

It is still another object of the present invention to provide a supercharger which can be quite readily disassembled and reassembled for purposes of low cost maintenance and repair.

Still another object of the present invention is to provide a supercharger which can be constructed from mass productible parts to thereby reduce the cost of its manufacture.

It is still another object of the present invention to provide a belt-driven supercharger which provides supercharging compression without resort to a larger number of compressor stages.

Yet another object of the present invention is to provide a rotary supercharger for a gas operated engine, which supercharger is easily manufactured and maintained, yet capable of providing ample recompression of the recirculating drive fluid.

SUMMARY OF THE INVENTION

These and other objects are achieved by the present invention which provides a supercharger comprising a housing having an inlet and an outlet, a shrouded axial compressor and a radial compressor rotatably mounted within the housing, a highly convergent shallow, frustoconical transition duct for favorably directing the discharge of the axial compressor to the inlet of the radial compressor.

In accordance with a further aspect of the invention, the above-described supercharger further comprises an exhaust cone at a location downstream of the radial compressor and a flow deflector for directing the discharge of the radial compressor to the exhaust cone.

In the preferred embodiment, the housing itself comprises four sections: a cylindrical front housing section which defines an axially directed inlet; a second, cylindrical ducting section enclosing the axial compressor; a rear housing section defining the transition duct as well as the inlet and casing for the radial compressor; and the exhaust cone section which defines at its terminis the outlet of the housing. For driving the compressor shaft, a double-tracked pulley wheel is secured to the forward end of the common shaft, which pulley wheel is adapted to receive one or more drive belts from the crank-shaft wheel of the engine. A lateral opening in the front housing section accommodates the connection with the drive belts.

With the disclosed arrangement, compression can be achieved for supercharging purposes without resort to a large number of compressor stages or high operating speeds. Additionally, the design of the disclosed supercharger avoids the need for guide vanes between the axial compressor and the radial compressor. The exhaust cone section also favorably avoids the build-up of back pressure against the radial compressor. The design is also very simple and therefore inexpensive to manufacture and maintain.

Other objects, advantages and novel features of the present invention will become apparent from the following detailed description of the invention when considered in conjunction with the accompanying drawing.

BRIEF DESCRIPTION OF THE DRAWINGS

A preferred embodiment of the present invention is described in greater detail with reference to the accompanying drawing wherein like elements bear like reference numerals, and wherein:

FIG. 2 is a side view of the supercharger of FIG. 1;

FIG. 3 is a frontal view of the impeller of the supercharger of FIG. 1;

FIG. 4 is a cross-sectional view taken along line 4—4 of FIG. 1;

FIG. 5 is a cross-sectional view taken along line 5—5 in FIG. 1;

DETAILED DESCRIPTION OF THE PREFERRED EMBODIMENT

Figure 1:
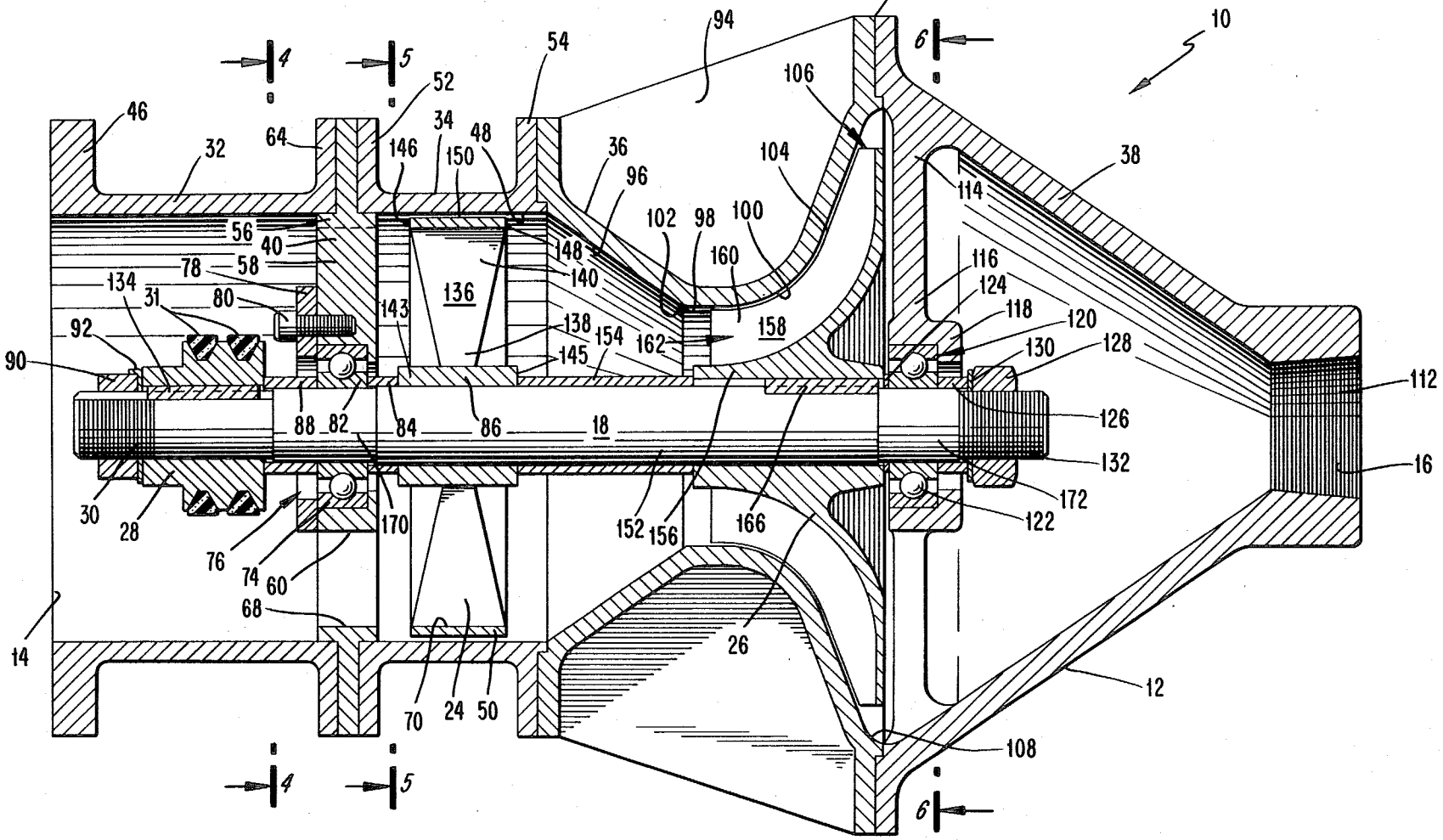
FIG. 1 is a cross-sectional side view of a supercharger constructed in accordance with the preferred embodiment of the present invention.

Referring to FIGS. 1 and 2, a supercharger 10 is provided for supplying supercharged air to an automobile engine or the like, so that the engine receives a greater weight per unit volume of air or a fuel/air mixture than would be otherwise supplied. In accordance with a preferred embodiment of the present invention, the supercharger 10 comprises a housing 12 having an axially directed inlet 14 for receiving ambient air and an axially directed outlet 16 for delivering supercharged air to the intake of the automobile engine. Rotatably mounted within the housing 12 is a shaft 18 on which are secured an axial compressor 24 and a radial compressor 26, the radial compressor 26 being positioned downstream of the axial compressor 24. A pulley wheel 28 is secured to a forward end 30 of the shaft for receiving drive belts 31, which belts drivingly connect the shaft 18 to a pulley wheel on the crankshaft of the engine (not shown). The drive belts 31 deliver torque to the shaft 18 as required for driving the compressors 24 and 26 of the supercharger 10.

The housing 12 itself is constructed from four sections which are preferably bolted together at flanged connections in end-to-end relationship. These sections include a front housing section 32, an axial compressor duct section 34, a rear housing section 36 and an exhaust cone section 38. The shaft 18 extends along the longitudinal axis of the housing 12.

The front housing section 32 is a hollow cylinder which extends forward of a front bearing support 40. The front housing section 32 encloses the forward end 30 of the shaft 18 and the associated pulley wheel 28. At its forward end, the front housing section 32 defines the inlet 14 for receiving air from an external source (not shown). Referring particularly to FIG. 2, the front housing section 32 includes a lateral opening 44 on one side in order to accommodate the connection of the drive belts 31 to the pulley wheel 28. The front housing section 32 also includes a forward flange 46 for accommodating the connection of air filters, carburetors, air scoops or the like upstream of the supercharger 10 according to the particular engine layout.

It is to be understood that in the usual engine layout, the supercharger 10 receives air or a fuel/air mixture from an external source through its inlet 14, compresses the air or fuel/air mixture and then delivers it to the intake of the engine.

Referring again to FIG. 1, the pulley wheel 28 is interference-fitted upon the forward end 30 of shaft 18 and a key 134 is used to lock the pulley wheel 28 in place. The pulley wheel 28 is preferably a double-track design which is suitable for the attachment of twin drive belts, although a single-belt type pulley wheel would be adequate. The pulley wheel 28 is preferably sized such that the ratio of its diameter with respect to the diameter of the drive wheel of the engine's crankshaft provides an effective gearing ratio in the range of approximately two and one-half to four and one-half. Thusly at idle, when the automobile engine is running approximately 700 rpm, the supercharge 10 is running at approximately 2,400 rpm, and at cruise, when the engine is running in the range of 2,500, the supercharger 10 is preferably turning over in the range of 6,000 to 8,000 rpm. It is to be noted that although the diameter of the pulley wheel 28 may be substantially reduced in order to achieve a desired gearing ratio, the double-track wheel 28 presents a sufficient sum total of surface area to avoid slippage of the belts 31.

The next adjacent section of housing 12 is the axial compressor duct 34 comprising a short cylinder which is coaxially disposed about the axial compressor 24. Preferably, the axial compressor duct 34 is constructed from cast aluminum, with the interior surfaces 48 machined to assure uniform clearance between the duct 34 and a shroud 50 of the axial compressor 24. As with other sections of the housing 12, the axial compressor duct 34 is provided with flanges 52 and 54 for effecting connection to the adjacent housing sections. The axial compressor duct 34 guides air delivered from the front housing section 32 toward the axial compressor 24.

Referring now to FIGS. 1 and 4, a front bearing support 40 is interposed between the front housing section 32 and the axial compressor duct 34. The front bearing support 40 includes an outer annulus 56 and three radially directed arms 58 between which arms are defined passages 60 for allowing air to pass through the bearing support 40. The outer annulus 54 is secured by bolts connecting a rear flange 64 of the front housing section 32 and the flange 52 of the axial compressor duct 34. By such arrangement, the front bearing support 40 is rigidly secured to the housing 12 such that loads and shocks to the shaft 18 can be transferred through the front bearing support 40 to the housing 12.

In the preferred embodiment, the outer annulus 56 of the bearing support 40 extends into the region of the inlet 14 of the front housing section 32 such that its inner rim 68 coincides with the inner rim 70 of the shroud 50 of the axial compressor 24. In this fashion the outer annulus 56 contributes to the guiding of the flow of air toward the axial compressor 24.

An outer raceway 74 of the front roller bearing assembly 76 is secured between the front bearing support 40 and a bearing retainer plate 78, which plate 78 is secured by removable bolts 80. In the preferred embodiment, the front bearing assembly 76 is of the sealed, high speed type. A suitable commercially available bearing assembly is marketed under model Fafnir 405KDD. A lower raceway 82 of the front bearing assembly 76 is preferably secured to the shaft 18 with an interference fit. A spacer 84 is provided on one side of the lower raceway 82, which spacer 84 also abuts a hub 86 of the axial compressor 24 to thereby place the axial compressor 24 a predetermined distance downstream of the bearing support 40. Similarly, a spacer 88 is provided on the other side of the lower raceway 84, which spacer 88 also abuts the pulley wheel 28 so as to space apart the pulley wheel 28 from the front bearing support 40 to assure sufficient clearance between same.

It is to be appreciated that the bearing retainer plate 78 allows ready access to the front bearing assembly 76 for purposes of maintenance or repair. To service the front bearing assembly 76, a nut 90 and lock-washer 92 on the forward end 30 of the shaft 18 are loosened and removed together with the pulley wheel 28 and the spacer 88. Then bolts 42 and the bearing retainer plate 76 are removed, leaving the whole bearing assembly 76 exposed for servicing and/or removal.

The rear housing section 36 is connected by bolts to the downstream end of the axial compressor duct 34. Preferably, the rear housing section 36 is constructed from a single section of cast aluminum and includes external longitudinal ribs 94 for enhancing the structural rigidity of the rear housing section 34. The walls of the rear housing section 36 define three elements of the supercharger 10: a highly conical transition duct 96 which favorably directs the output of the axial compressor to an inlet 98 of the radial compressor 26; the inlet 98 of the radial compressor 26, itself; and a casing 100 for the radial compressor 26.

The transition duct 96 is a hollow, frustoconical portion having a half-apex angle (from the generatrix to the axis of symmetry) of approximately 35°. The angle is selected such that the inlet to the radial compressor 26 is as close as possible to the outlet of the axial compressor 24 without causing undue back-pressure. In the preferred embodiment, the transition duct 96 begins a short distance downstream of the axial compressor 24 and ends at the beginning of the inlet 98 of the radial compressor 26. The highly conical shape of the transition duct 96 is believed to roll-in the higher volume of air being discharged from the more radially outward portions of the axial compressor 24. This rolling-in action is believed to promote a favorable flow regime at the inlet 98 of the radial compressor 26 such that the need for inlet guide vanes for the radial compressor 26 is avoided. It is also believed that the highly conical shape of the transition duct 96 affects upstream flow conditions at the axial compressor 24 such that its performance is improved. It has also been found that the need for a stator (or exit guide vane) for the axial compressor 24 is likewise avoided.

In essence, it is believed that the transition duct 96 performs the functions of the aforementioned exit vanes of axial compressors and inlet guide vanes of radial compressors, but without the pressure losses commonly associated with them. Because of the avoidance of these pressure losses and by reason of the expected improvement in the performance of the axial compressor, the supercharger 10 is able to impart a higher overall pressure ratio than would otherwise be achieved without the transition duct 96. As a result, adequate compression is achieved at moderate operating speeds without resort to a bank of several axial compressors. It is to be understood, however, that when connecting the supercharger 10 to a relatively slowly reciprating diesel or a very large engine, it may be desirable to include two or more axial compressors in order to boost the supercharger's overall pressure ratio. In such case, practice of the present invention would include the placement of a transition duct as above described downstream of at least the last axial compressor.

At the inlet 98 of the radial compressor 26, the walls of the rear housing 36 are cylindrical and coaxially disposed about the shaft 18. It is to be noted that in the preferred embodiment, the surface transition 102 from the transition duct 96 to the inlet 98 is rounded-off.

The casing portion 100 of the rear housing section 36 closely follows the contour defined by blade edges 104 of the radial compressor 26 in a close, substantially sealing manner as is well known in the art of radial compressors. The casing portion 100 of the rear housing section 78 channels air between the rotating blades of the radial compressor 26 so that the blades can impart work to the passing air. The casing portion 100 also defines a discharge outlet 106 for the radial compressor 26.

Just beyond the discharge outlet 106 of the radial compressor 26, the interior surfaces of the rear housing section 36 begin to curve immediately inwardly to provide a transition into the next adjacent section of the housing 12, the exhaust cone 38. In this fashion, the interior surfaces at the rear-most portion of rear housing section 36 and those of the forward portion of the exhaust cone 92 define internally a flow deflector 108. In the preferred embodiment, the flow deflector 108 is closely and concentrically disposed about the outlet 106 of the radial compressor 26 such that the air being discharged from the radial compressor 26 does not have the opportunity to diffuse significantly prior to its arrival at the annular flow deflector 108. The annular flow deflector 108 directs the output of the radial compressor 26 into the exhaust cone 38 by providing a smooth surface transition from the interior of rear housing section 36 to the interior of the exhaust cone 38.

The exhaust cone 38 is a highly convergent, hollow, frustoconical section placed immediately downstream of the radial compressor 26 for receiving the output of the radial compressor 26 from the annular flow deflector 108. In the preferred embodiment, the exhaust cone 38 is a single section of cast aluminum which is joined to the downstream end of the rear housing section 36 at a flanged joint 110. Preferably, the exhaust cone 92 converges according to a half-apex angle of approximately 35° and defines the exhaust port 16 at its terminus. Threading 112 at the exhaust port 16 accommodates the attachment of the appropriate external ducting (not shown) leading to the intake of the engine.

During operation of the supercharger 10, the space enclosed by the exhaust cone 92 prevents the build up of an elevated back pressure which might otherwise arise and detract from the operation and efficiency of the radial compressor 26. The enclosed space of the exhaust cone 92 is also of sufficient volume to absorb pulses and to average out unsteady flow conditions so to promote a smooth and continuous output from the supercharger 10.

Figure 6:
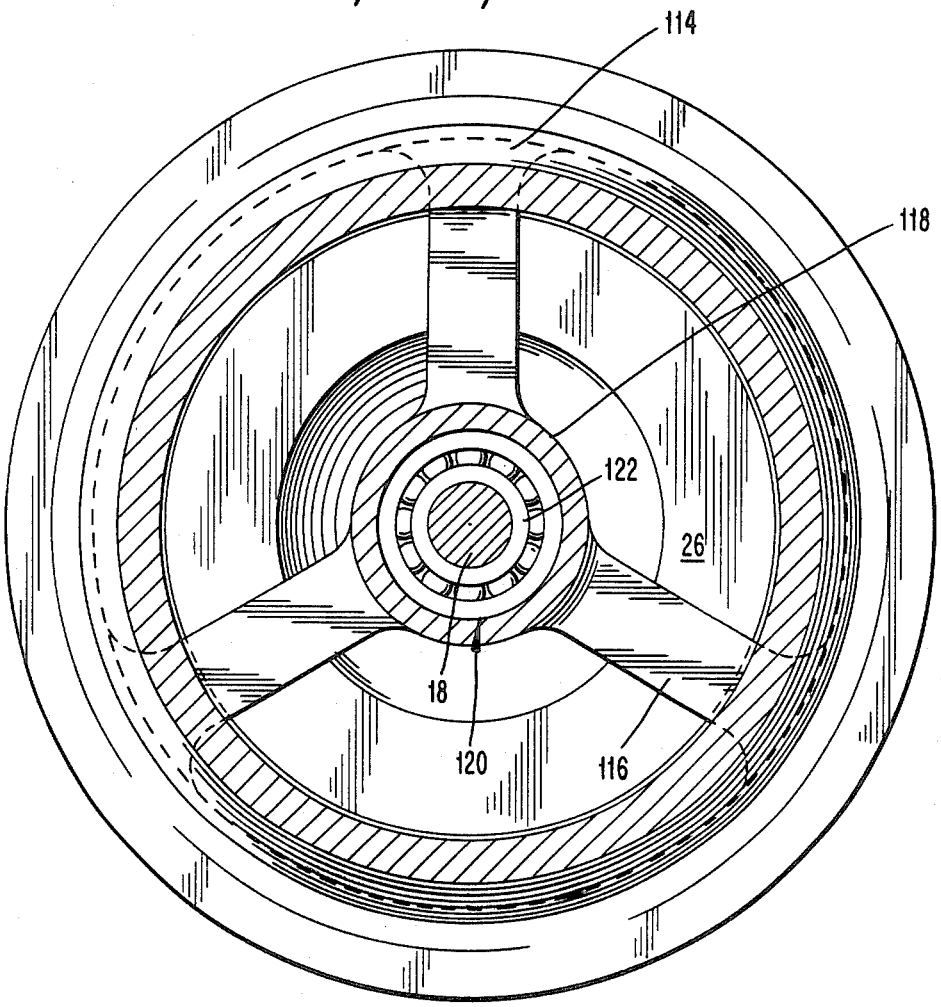
FIG. 6 is a cross-sectional view taken along line 6—6 in FIG. 1.

Referring now to FIGS. 1 and 6, the exhaust cone 38 includes a rear bearing support 114 which comprises members 116 which extend radially inwardly from the outer walls of the exhaust cone 38. At a radial inward location close to the shaft 18, the members 116 converge to form a cupped annulus which serves as a housing 118 for the rear bearing assembly 120. The housing 118 is open towards the rear face of the radial compressor 24 to facilitate disassembly of the supercharger 10. The rear bearing assembly 120 is the same type and size as the front bearing assembly 76. The inner race 122 of the bearing assembly 120 is set in place on the shaft 18 by spacers 124 and 126 in conjunction with a nut 128 and washer 130 on the rearward end 132 of the shaft 18. In the preferred embodiment, the members 116 are integrally formed with the walls of the exhaust cone 38.

Referring to FIGS. 1 and 5, the axial compressor 24 upon rotation draws air through the inlet 14 and imparts an initial amount compression to the air as it forces the air into the transition duct 96 of the rear housing section 36. In the preferred embodiment, the axial compressor 24 comprises a hub 86, the shroud 50 and a series of ten (10) equally spaced, radially disposed blades 136. Preferably, each blade 136 increases in cord from a root 138 to a tip 140 and includes a trailing edge 142 and a leading edge 144, which edges are both slightly curved. The blades gradually increase in pitch from approximately 12° at the root 138 to approximately 36° at the tips 140. However, the particular values of pitch and other geometrical aspects of the blades 136 might be varied in accordance with different operating speeds or other parameters as would be apparent to one skilled in the pertinent art and familiar with this disclosure.

The axial compressor 24 is preferably constructed from a single, cast aluminum section with the faces 143 and 145 of the hub 86 being machined for purposes of achieving accurate, axial positioning of the axial compressor 24 on the shaft 18 relative to the housing 12. The faces 146 and 148 of the shroud 72 are also machined flat. Additionally, the outer periphery 150 of the shroud is machined to assure uniform clearance between the shroud and the adjacent interior surfaces 48 of the axial compressor duct 34. The axial compressor 24 is preferably secured to the shaft 18 by an interference-fit onto a stepped portion 152 of the shaft 18. The spacers 84 and 154 axially position the axial compressor 24 relative to the front bearing support 40 and the radial compressor 26, respectively.

Dynamic balance test machines of the conventional type may be used to test the balance of the axial compressor 24 prior to its installation. If an imbalance is detected, material can be removed at the outer periphery 150 of the shroud 50 so as to achieve proper balance.

Figure 7:
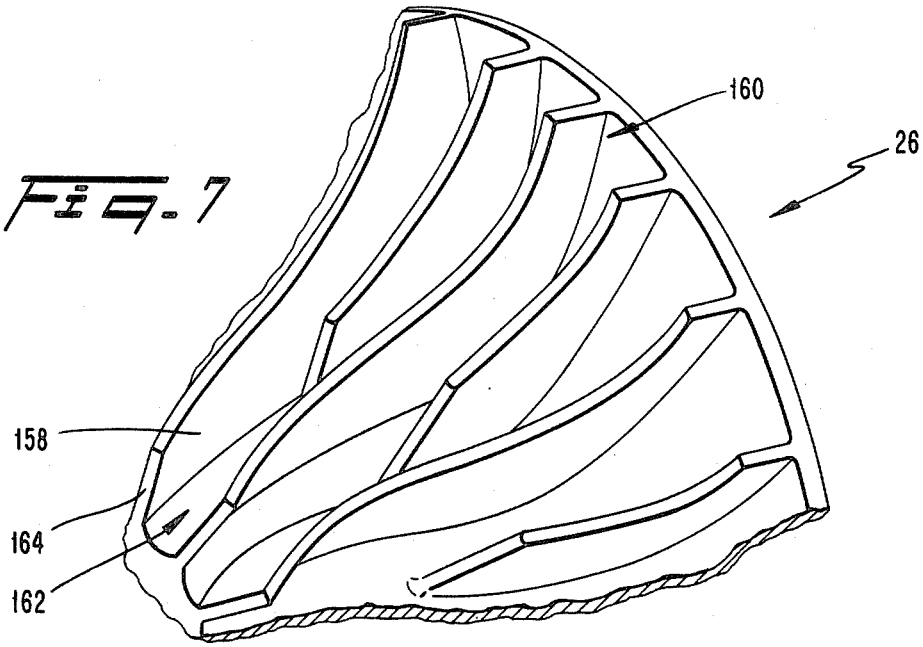
FIG. 7 is a perspective view of a segment of the impeller of the supercharger of FIG. 1.

Referring now to FIGS. 1, 3, and 7, the radial compressor 26 is constructed from a single section of cast aluminum and includes a hub 156 and curved blades 158. Interposed between each pair of blades 158 are a second set of blades 160 which terminate short of the intake 162 of the radial compressor 26 so that the intake 162 is not crowded by both sets of blades. Accordingly, the radial compressor 26 features both a large total number of blades and an intake of relatively small diameter, which features enhance the performance of the compressor 26. In the region of the intake 162, the blades 158 present leading edges 164 and undergo a twist into the direction of rotation so as to prevent a favorable angle of attack at the intake 162.

Preferably, the radial compressor 26 is positioned upon the stepped section 128 of the shaft 18 with an interference-fit and locked against rotational slippage by a key 166. The spacer 124 assures clearance between the rear face of the radial compressor 26 and the rear bearing assembly 120.

The shaft 18 is constructed from a hardened steel and is threaded at both ends 30 and 132 for receiving nuts 90 and 128, respectively. In addition to the central stepped portion 152, which receives the compressors 24 and 26, the shaft 18 also features stepped portions 170 and 172 for receiving the front and rear bearing assemblies 76 and 120, respectively. The stepped arrangement of the shaft 18 facilitates assembly and disassembly in that the stepped portion 152 of the greatest diameter is centrally located on the shaft 18 and all the stepped portions are greater than the diameter of the threading at ends 30 and 132.

It is to be noted that the bearing supports 40 and 114 are in a fixed position relative to the housing 12 and that the compressors 24 and 26 are positioned between the bearing supports 22 and 40 by spacers 84, 124 and 154, which spacers have predetermined lengths. Consequently, the placement of the compressors 24 and 26 relative to the longitudinal axis of the housing 12 is fixed by the aforementioned spacers and not by the axial location of the shaft 18 relative to the housing 12. It is also to be noted that the stepped portions 152, 170 and 172 of the shaft 18 are each provided with extra lengths such that the respective components (the bearing assemblies and compressors) can each be situated over a relatively wide range of situses in the respective stepped portions. Thusly, the shaft 18 need not be accurately positioned along the longitudinal axis of the housing 12 in order to achieve proper assembly of the supercharger 10. For instance, if nuts 90 and 128 had been tightened differently than as they appear in FIG. 1, the shaft 18 might have been displaced slightly in the axial direction from where it is shown in FIG. 1. However, the relative positioning of the various components on the shaft 18, i.e., the pulley wheel 28, the compressors 24 and 26 and the bearing assemblies 76 and 120, would have remained the same relative to themselves and the housing 12. This feature eases the process of manufacture and accordingly, reduces the costs of same. It also reduces the amount of labor required for reassembly after repair.

In operation, the supercharger 10 is suitably connected at its outlet 16 to an intake of an automobile engine, with the drive belts 31 from the crankshaft of the engine being attached to the pulley wheel 28 of the supercharger 10. Then, as the engine is operated, torque is transferred by the drive belts 31 to the pulley wheel 28 for driving the compressors 24 and 26. Upon rotation, the axial compressor 24 draws air through the inlet 14, imparts an initial amount of compression to the air and discharges it into the transition duct 96 with a swirl. By reason of its design, the axial compressor 24 is believed to move a greater volume of air in the region of its blade tips 140 than at its more radially inward locations. Accordingly, there is a greater of mass of air situated at the outer annular region behind the axial compressor 24 than at the inner annular region. As the discharge from the axial compressor 24 is caused to leave the axial compressor duct 34, the highly convergent, transition duct 96 is believed to cause the outer annulus of air which is discharged from the axial compressor 24 to roll-in. This action is believed to have two favorable results. First, the roll-in action causes a flow regime to be established at the inlet 98 of the radial compressor 26 such that the need for a guide vane is wholly avoided. Secondly, and of equal importance, the rolling-in action, in conjunction with the large volume of space enclosed by the transition duct 96, is believed to favorably effect the performance of the axial compressor 24 such that a higher pressure ratio is obtained therefrom.

Since the overall pressure ratio of the supercharger 10 is the product of the pressure ratios of the two compressors, it can be seen that the aforementioned increase in performance of the axial compressor 24 results in a corresponding improvement in overall performance of the supercharger 10. It is also to be noted that the deletion of inlet guide vanes for the radial compressor 26 and of exit vanes for the axial compressor 24 greatly simplifies the design of the rear housing section 36 and therefore provides savings in costs of manufacture. It also avoids the pressure losses associated with such guide vanes, which are often quite significant.

Upon leaving the transition duct 96, the pre-swirled flow of air enters the inlet 98 of the radial compressor 26 and then into the compressor 26 itself. In passing through the radial compressor 26, the air is turned and whirled such that the airflow is centrifugally discharged with a substantial radial velocity component, whereupon the resultant flow is abruptly turned by the annular flow deflector 108 and caused to enter the exhaust cone 38. As previously explained, the large volume of space enclosed by the exhaust cone 38 induces flow conditions behind the radial compressor 26 such that elevated back pressures are avoided which might otherwise impair the performance of the radial compressor 26. Pulses in the output of the radial compressor 26 are also moderated. The air is then delivered in a compressed state to the exhaust port 16 of the exhaust cone 38. The supercharged air then flows down the appropriate intake system of the engine until it reaches the cylinder or cylinders of the engine.

Figure 8:
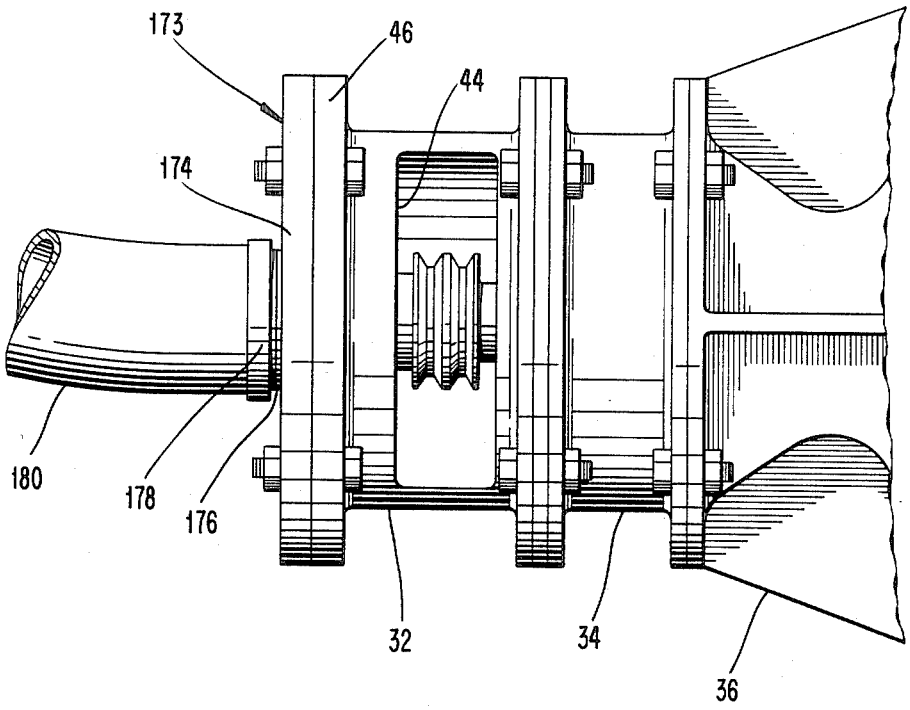
FIG. 8 is a partial side view of the supercharger of FIG. 1 with an adaptor.

With respect to the application of the supercharger 10 to air-tank powered engines, such as disclosed in U.S. Pat. No. 4,292,804, the supercharger 10 functions in the same manner as described above, but is connected to the engine differently. In the air tank powered engine, at least one of the exhaust manifolds of the engines delivers partially expanded air to a line connected to the inlet 14 of the supercharger 10. Referring to FIG. 8, in most of such applications, this line will be of a smaller diameter than the housing 12 at the inlet 14 of the supercharger 10, such that an adaptor 173 is needed. The adaptor 173 comprises an annular plate 174 having a threaded aperture 176 sized to receive a mating, threaded end 178 of the aforementioned line 180. The plate 174 is secured the flange 36 of the front housing section 32 by a plurality of bolts. Because the air coming from the line 180 is usually less than the full capacity of the supercharger, additional air is introduced through the lateral opening 44 along the side of the front housing section 32. In this application, the opening 44 thusly serves as an air intake port as well as a means for accommodating the drive belts 31 and must therefore be sized upon the additional criteria that it not be so large as to upset the flow of the incoming air in the line 180. Upon the passage of the air through the supercharger, the air is directed through the exhaust port 16 and into a suitable line connected thereto, which line may lead directly to the engine or to the storage tanks of the engine. If directed to the tanks, this recompressed air is utilized to supplement the required recharging of the storage tanks.

It is to be appreciated that savings in the cost of manufacturing the supercharger 10 are achieved by reason that the housing 12, the bearing supports 40 and 114, the axial compressor 24 and the radial compressor 26 are all constructed from cast aluminum parts and require only a minimum amount of machining. Moreover, the roller bearing assemblies 76 and 120 are commercially available components, and the supercharger 10 is easily assembled. These aspects further reduce the cost of manufacture and render the disclosed supercharger inexpensive to maintain and overhaul. More importantly, the supercharger 10, despite its simple design, provides supercharging at relatively low operating speeds. With its lower operating speeds, the service life of the supercharger 10 is extended and the risk of it suffering mechanical failure is reduced. The need for special bearing designs and lubrication is also avoided. Accordingly, the supercharger 10 is highly suitable for mass production and for use in automobiles, trucks, helicoptors or the like.

It is to be understood that the present invention may be embodied in other specific forms without departing from the spirit or essential characteristics of the present invention. The preferred embodiments are therefore to be considered illustrative and not restrictive. The scope of the invention is set forth in the appended claims rather than by the foregoing descriptions and all changes or variations which fall within the meaning and range of the claims are therefore intended to be embraced therein.

What is claimed is:

1. A supercharger comprising:

a housing having a longitudinal axis and being constructed from sections, which sections are connected in end-to-end relationship with flanged joints, said sections including a front housing section defining an axially directed inlet, an axial compressor duct section for housing an axial compressor, a rear housing section downstream of said axial compressor duct section, and a hollow, highly convergent, frustoconical, exhaust cone section downstream of said rear housing section, a downstream portion of said rear housing section defining a cylindrical, axially directed inlet for a radial compressor, a casing for a radial compressor, and a substantially radially directed outlet for a radial compressor, said rear housing section further defining a highly convergent, hollow, frustoconical transition duct between a downstream end of said axial compressor duct section and said radial compressor inlet, said rear housing section having interior surfaces for defining a flow deflector, which flow deflector receives the output of said outlet for a radial compressor, which flow deflector provides a smooth surface transition from said rear housing section into said exhaust cone section, said exhaust cone section defining at a downstream end a coaxial outlet, said housing further including at least two bearing supports affixable within said housing according to predetermined locations along said longitudinal axis of the housing, said bearing mounts rotatably supporting a compressor shaft, which compressor shaft is positioned along said longitudinal axis;

sealed bearing assemblies removably implaced in said bearing supports, said sealed bearing assemblies receiving said compressor shaft;

a shrouded axial compressor located within said axial compressor duct and secured to said shaft to be rotatable therewith, said shrouded axial compressor drawing a flow from said inlet of the front housing section and imparting an initial compression to said flow;

a radial compressor located within said casing and secured to said shaft to be rotatable therewith, said casing being in a substantially sealing relationship with said radial compressor, said radial compressor including a hub, a first set of blades extending radially from said hub and having leading edges at an intake region of said radial compressor and a second set of blades extending radially from said hub and having leading edges downstream of said intake region, said radial compressor further compressing said flow;

at least one pulley wheel secured to said compressor shaft and adapted to receive drive belts;

spacers fitted upon said compressor shaft for axially positioning said axial compressor and said radial compressor relative to each other and relative to said bearing supports; and means for securing said compressor shaft against axial displacement;

wherein said transition duct favorably directs the output of the axial compressor into said inlet of the radial compressor and said exhaust cone section encloses sufficient volume to moderate the output of said radial compressor.

2. The supercharger as claimed in claim 1 wherein said transition duct section and said exhaust cone section each have a half-apex angle of approximately 35°.

3. A supercharger comprising:

a housing having a longitudinal axis and being constructed from sections, which sections are connected in end-to-end relationship, said sections including a front housing section defining an axially directed inlet, an axial compressor duct section for housing an axial compressor, a rear housing section downstream of said axial compressor duct section and an exhaust section having a hollow, highly convergent, frustoconical, exhaust cone portion downstream of said rear housing section, a downstream portion of said rear housing section defining a cylindrical, axially directed inlet for a radial compressor, a casing for a radial compressor, and a substantially radially directed outlet for a radial compressor, said rear housing section further defining a highly convergent, hollow, frustoconical transition duct between a downstream end of said axial compressor duct section and said radial compressor inlet, said rear housing section having interior surfaces for defining a flow deflector, which flow deflector receives the output of said outlet for a radial compressor, which flow deflector provides a smooth surface transition from said rear housing section into said exhaust section, said exhaust cone portion defining at a downstream end a coaxial outlet, said housing further including at least two bearing supports affixable within said housing according to predetermined locations along said longitudinal axis of the housing, said bearing mounts rotatably supporting a compressor shaft, which compressor shaft is positioned along said longitudinal axis;

bearing assemblies removably implaced in said bearing supports, said bearing assemblies receiving said compressor shaft;

an axial compressor located within said axial compressor duct and secured to said shaft to be rotatable therewith, said axial compressor drawing a flow from said inlet of the front housing section and imparting an initial compression to said flow;

a radial compressor located within said casing and secured to said shaft to be rotatable therewith, said casing being in a substantially sealing relationship with said radial compressor, said radial compressor including a hub, a first set of blades extending radially from said hub and having leading edges at an intake region of said radial compressor and a second set of blades extending radially from said hub and having leading edges downstream of said intake region, said radial compressor further compressing said flow;

at least one pulley wheel secured to said compressor shaft and adapted to receive drive belts;

spacers fitted upon said compressor shaft for axially positioning said axial compressor and said radial compressor relative to each other; and means for securing said compressor shaft against axial displacement;

wherein said transition duct favorably directs the output of the axial compressor into said inlet of the radial compressor and said exhaust cone section encloses sufficient volume to moderate the output of said radial compressor.

4. The supercharger as claimed in claim 3, wherein said exhaust cone portion has a half-apex angle of approximately 35°.

5. The supercharger as claimed in claim 3, wherein said transition duct has a half-apex angle of 35°.

6. The supercharger as claimed in claim 3, wherein said transition duct is substantially coaxial with said inlet of the radial compressor.

7. The supercharger as claimed in claim 3, wherein said axial compressor comprises a hub, a plurality of blades extending radially from said hub and a shroud connected to tips of said blades.

* * * * *